US009530596B1

(12) United States Patent
Linton

(10) Patent No.: US 9,530,596 B1
(45) Date of Patent: Dec. 27, 2016

(54) MULTIWAY SWITCHING APPARATUSES FOR ELECTRICAL APPLIANCES

(71) Applicant: Steven Alexander Linton, Lake Stevens, WA (US)

(72) Inventor: Steven Alexander Linton, Lake Stevens, WA (US)

( * ) Notice: Subject to any disclaimer, the term of this patent is extended or adjusted under 35 U.S.C. 154(b) by 0 days.

(21) Appl. No.: 14/958,938

(22) Filed: Dec. 4, 2015

(51) Int. Cl.
*H05B 37/02* (2006.01)
*H01H 47/00* (2006.01)

(52) U.S. Cl.
CPC ..... *H01H 47/001* (2013.01); *H05B 37/02* (2013.01)

(58) Field of Classification Search
CPC ..... H01H 47/001; H05B 37/02
USPC ..... 307/114
See application file for complete search history.

(56) References Cited

U.S. PATENT DOCUMENTS 2,201,898 A * 5/1940 Holiday ..... H01H 51/12 307/114
3,418,488 A * 12/1968 Platzer, Jr. ..... H01R 31/00 307/114
3,496,379 A * 2/1970 Platzer, Jr. ..... H01R 31/00 307/114
3,514,626 A * 5/1970 Platzer, Jr. ..... H01R 29/00 307/114
3,860,910 A * 1/1975 Hudson ..... H02G 3/00 307/113
3,872,319 A * 3/1975 Platzer, Jr. ..... H05B 37/02 307/114
4,578,593 A * 3/1986 Davidov ..... H05B 37/0209 307/113
4,639,612 A * 1/1987 Bowman-Jones ..... H01H 1/52 307/114
4,804,862 A * 2/1989 Bowman-Jones ..... H01H 83/20 200/291
4,825,096 A * 4/1989 Fabrizi ..... H01H 83/20 307/112

* cited by examiner

*Primary Examiner* — Ramon M Barrera
(74) *Attorney, Agent, or Firm* — Evergreen Valley Law Group; Kanika Radhakrishnan

(57) ABSTRACT

Disclosed is a switching apparatus for an electrical appliance where the switching apparatus includes a plurality of electric switches connected to the electrical appliance. Each electric switch is configured to switch ON/OFF the electrical appliance. A plurality of interconnected ON solenoid devices and a plurality of interconnected OFF solenoid devices are electro-magnetically coupled to ON terminals and OFF terminals of the plurality of electric switches, respectively. Upon flipping an electric switch to an ON operating position a respective OFF solenoid device coupled to the electric switch is de-activated causing de-activation of remaining OFF solenoid devices thereby electro-magnetically flipping remaining electric switches to respective ON operating positions. Also, upon flipping the electric switch to an OFF operating position a respective ON solenoid device coupled to the electric switch is de-activated causing de-activation of remaining ON solenoid devices thereby electro-magnetically flipping the remaining electric switches to respective ON operating positions.

20 Claims, 6 Drawing Sheets

MULTIWAY SWITCHING APPARATUSES FOR ELECTRICAL APPLIANCES

TECHNICAL FIELD

The present disclosure relates to electric switches, and more particularly, to a multiway switching mechanism for controlling switching operation of an electrical appliance.

BACKGROUND

In building electrical wiring, generally provisions are made to operate electrical appliances (e.g., electric lightings, electric fans, televisions or any other similar electrical appliances) using multiple electric switches installed at different locations. Controlling an electrical appliance using multiple electric switches is typically referred as a multiway switching connection. For example, an electric lighting in a large room may be switched 'ON' or switched 'OFF' using three electric switches, where one electric switch may be installed at one side of a room, another electric switch may be installed an opposite side of the room, and another electric switch may be installed at a stairwell leading to the room. In such wiring systems where multiple electric switches control switching operation of an electrical appliance, each of the electric switches may not be in 'ON' position when the electrical appliance is switched 'ON', and similarly each of the electric switches may not be in 'OFF' position when the electrical appliance is switched 'OFF'. Such arrangement is very confusing for the users, as a same position of an electric switch may be used for the both purposes i.e., the switching ON or the switching OFF of the electrical appliance.

There are existing techniques for maintaining each of the electric switches in the same position (i.e., either 'ON' or 'OFF' depending upon the current operating state of the electrical appliance). Such techniques are implemented by including air lines or hydraulic lines in addition to wiring between the electric switches. However, the implementation of such air lines or hydraulic lines is less effective and difficult to maintain, and moreover it requires cumbersome work for installing such additional lines in the building structures.

SUMMARY

The present disclosure provides a switching apparatus for controlling switching of an electrical appliance using multiple electric switches, where all of the electric switches remain in same operating position.

In an embodiment, a switching apparatus for an electrical appliance is disclosed. The switching apparatus includes a plurality of electric switches, a plurality of ON solenoid devices and a plurality of OFF solenoid devices. The plurality of electric switches are electrically connected to the electrical appliance. Each electric switch of the plurality of electric switches is configured to be flipped to an ON operating position for switching ON the electrical appliance and is configured to be flipped to an OFF operating position for switching OFF the electrical appliance. The plurality of ON solenoid devices are electro-magnetically coupled to ON terminals corresponding to ON operating positions of the plurality of electric switches in a respective manner. The plurality of ON solenoid devices are electrically connected to each other. The plurality of OFF solenoid devices are electro-magnetically coupled to OFF terminals corresponding to OFF operating positions of the plurality of electric switches in a respective manner. The plurality of OFF solenoid devices are electrically connected to each other. When an electric switch of the plurality of electric switches is flipped to an ON operating position of the electric switch, a respective OFF solenoid device coupled to the electric switch is de-activated. The de-activation of the respective OFF solenoid device causes de-activation of remaining OFF solenoid devices of the plurality of OFF solenoid devices thereby electro-magnetically flipping remaining electric switches of the plurality of electric switches to respective ON operating positions. When the electric switch is flipped to an OFF operating position of the electric switch, a respective ON solenoid device coupled to the electric switch is de-activated. The de-activation of the respective ON solenoid device causes de-activation of remaining ON solenoid devices of the plurality of ON solenoid devices thereby electro-magnetically flipping the remaining electric switches of the plurality of electric switches to respective OFF operating positions.

In another embodiment, a switching apparatus for an electrical appliance is disclosed. The switching apparatus includes a plurality of electric switches, a plurality of ON solenoid devices and a plurality of OFF solenoid devices. The plurality of electric switches are electrically connected to the electrical appliance. Each of the plurality of electric switches is configured to be flipped to an ON operating position for switching ON the electrical appliance and is configured to be flipped to an OFF operating position for switching OFF the electrical appliance. The plurality of ON solenoid devices are electro-magnetically coupled to ON terminals corresponding to ON operating positions of the plurality of electric switches in a respective manner. The plurality of ON solenoid devices are electrically connected to each other. The plurality of OFF solenoid devices are electro-magnetically coupled to OFF terminals corresponding to OFF operating positions of the plurality of electric switches in a respective manner. The plurality of OFF solenoid devices are electrically connected to each other. When an electric switch of the plurality of electric switches is flipped to an ON operating position of the electric switch, a respective ON solenoid device coupled to the electric switch is activated. The activation of the respective ON solenoid device causes activation of remaining ON solenoid devices of the plurality of ON solenoid devices thereby electro-magnetically flipping remaining electric switches of the plurality of electric switches to respective ON operating positions. When the electric switch is flipped to an OFF operating position of the electric switch, a respective OFF solenoid device coupled to the electric switch is activated. The activation of the respective OFF solenoid device causes activation of remaining OFF solenoid devices of the plurality of OFF solenoid devices thereby electro-magnetically flipping the remaining electric switches of the plurality of electric switches to respective OFF operating positions.

In another embodiment, a switching apparatus for an electrical appliance is disclosed. The switching apparatus includes a plurality of electric switches, a plurality of ON solenoid devices and a plurality of OFF solenoid devices. The plurality of electric switches are electrically connected to the electrical appliance. Each of the plurality of electric switches is configured to be flipped to an ON operating position for switching ON the electrical appliance and is configured to be flipped to an OFF operating position for switching OFF the electrical appliance. The plurality of ON solenoid devices are electro-magnetically coupled to ON terminals corresponding to ON operating positions of the plurality of electric switches in a respective manner. The plurality of ON solenoid devices are electrically connected to each other. The plurality of OFF solenoid devices are electro-magnetically coupled to OFF terminals corresponding to OFF operating positions of the plurality of electric switches in a respective manner. The plurality of OFF solenoid devices are electrically connected to each other. When an electric switch of the plurality of electric switches is flipped to an ON operating position of the electric switch, a respective ON solenoid device coupled to the electric switch is activated and a respective OFF solenoid device coupled to the electric switch is de-activated. The activation of the respective ON solenoid device causes activation of remaining ON solenoid devices of the plurality of ON solenoid devices and the de-activation of the respective OFF solenoid device causes de-activation of remaining OFF solenoid devices of the plurality of OFF solenoid devices, thereby electro-magnetically flipping remaining electric switches of the plurality of electric switches to respective ON operating positions. When the electric switch is flipped to an OFF operating position of the electric switch, the respective OFF solenoid device coupled to the electric switch is activated and the respective ON solenoid device coupled to the electric switch is de-activated. The activation of the respective OFF solenoid device causes activation of the remaining OFF solenoid devices and the de-activation of the respective ON solenoid device causes de-activation of the remaining ON solenoid devices, thereby electro-magnetically flipping the remaining electric switches to respective OFF operating positions.

In an embodiment, the plurality of ON solenoid devices and the plurality of OFF solenoid devices are electro-mechanical solenoid devices.

In an embodiment, an ON solenoid device of the plurality of ON solenoid devices includes a movable armature configured within a casing. The movable armature is configured to exert an electro-magnetic force on a respective electric switch coupled to the ON solenoid device for flipping the respective electric switch.

In an embodiment, an OFF solenoid device of the plurality of OFF solenoid devices includes a movable armature configured within a casing. The movable armature is configured to exert an electro-magnetic force on a respective electric switch coupled to the OFF solenoid device for flipping the respective electric switch.

In an embodiment, each of the plurality of ON solenoid devices includes an input terminal and an output terminal. An output terminal of the respective ON solenoid device is electrically coupled to input terminal of each of the remaining ON solenoid devices and an input terminal of the respective ON solenoid device is electrically coupled to output terminal of each of the remaining ON solenoid devices.

In an embodiment, each of the plurality of OFF solenoid devices includes an input terminal and an output terminal. An output terminal of the respective OFF solenoid device is electrically coupled to input terminal of each of the remaining OFF solenoid devices and an input terminal of the respective OFF solenoid device is electrically coupled to output terminal of each of the remaining OFF solenoid devices.

In an embodiment, the electric switch includes at least one of a push button switch, a toggle switch and a rocker switch. Embodiments of the present disclosure substantially eliminate or at least partially address the aforementioned problems in the background, and provide a multi-switch switching apparatus. The switching apparatus simplifies use of an electric switch, when more than one electric switch is used to operate an electrical appliance. More specifically, the switching apparatus turns all electric switches connected to the electrical appliance in the same position when one electric switch is pressed or flipped to one position. In such a scenario, there is no confusion for users to use the switching apparatus since, all the switches are operating in a same position corresponding to an operation of the electrical appliance. Moreover, the use of solenoid devices eliminates the need for other alternatives such as air lines or hydraulic lines to actuate all the electric switches in the same position in a multi-switch environment for operating a single electrical appliance.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Figure 1:
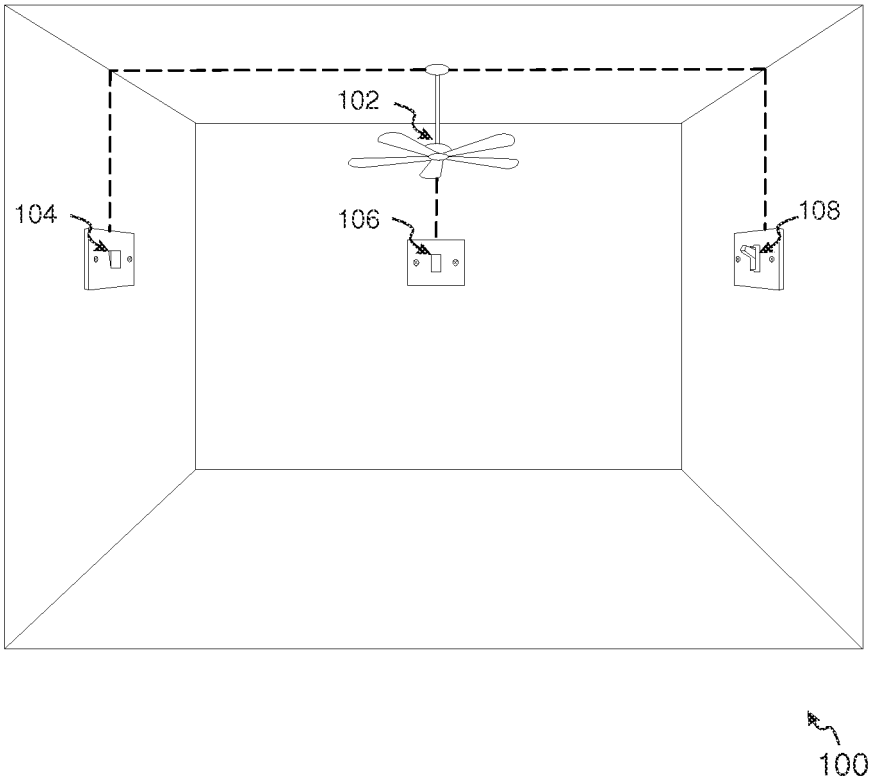
FIG. 1 is a schematic representation of a multi-switch switching operation of an electrical appliance in accordance with an example scenario.

Referring now to the drawings, particularly by their reference numbers, FIG. 1 is an example schematic representation 100 of a multi-switch switching operation of an electrical appliance 102, in an example scenario. The electrical appliance 102 is shown to be an electric ceiling fan for example purposes only and that the electrical appliance 102 may be any electrical appliances that can be switched ON/OFF by electric switches, for example, light bulbs, televisions, air conditioners, electric heaters, refrigerators, electric kettles, and the like.

The electrical appliance 102 may be controlled using one or more electric switches. For instance, the electrical appliance 102 may be switched 'ON' and switched 'OFF' using one or more electric switches connected to the electrical appliance 102 in a multiway connection. As shown in the schematic representation 100, three electric switches (see, 104, 106 and 108) installed in different walls of a room, are electrically connected to the electrical appliance 102. A user may press or flip any one of the electric switches 104, 106 and 108 (hereinafter referred to as the 'electric switches 104-108') to switch 'ON' or switch 'OFF' the electrical appliance 102. It is noted that only three electric switches (i.e., the electric switches 104-108) are shown in FIG. 1 for example purposes, and that the electrical appliance 102 may be connected to fewer or more number of electric switches than those depicted in FIG. 1. As shown in FIG. 1, the electric switches 104 and 106 are shown as push button switches and the electric switch 108 is shown as a toggle switch for example purposes only and that the electric switches 104-108 may include any combination of electric switches from among a push button switch, a toggle switch, a rocker switch and the like.

The electric switches 104-108 are connected to the electrical appliance 102 by running wires through each of the electric switches 104-108 and the electrical appliance 102. Moreover, each of the electric switches 104-108 may provision power supply or cut-off power supply to the electrical appliance 102 based on an operating position of that electric switch. The electric switches 104-108 are connected to an electrical power source (not shown in FIG. 1) responsible for providing electrical power supply to the electrical appliance 102. For example, the electrical power source may include an alternating-current power supply of about 100 to 230 volts (i.e. household electrical supply). The operating position of an electric switch (of the electric switches 104-108) may correspond to either the electric switch being flipped or pressed towards an 'ON' terminal or to an 'OFF' terminal by a user. Without loss of generality, in an example implementation, the ON terminal may be connected to a node that is connected to the electrical power source and the OFF terminal is connected to ground terminal. In such implementation, when a first half of the front side of the electric switch is pressed, the ON terminal (that is connected to the electrical power source) is connected to a node that supplies electrical power to the electrical appliance 102, thereby switching ON the electrical appliance 102. Further, when a second half of the front side of the electric switch is pressed, an OFF terminal is connected to the node that supplies electrical power to the electrical appliance 102 thereby switching OFF the electrical appliance 102. It may be noted that the electric switch may have various configurations, and it can generally be construed that when the ON terminal is actuated (e.g., the first half of the front side of the electric switch is pressed), a power supply node is connected to a node that is further connected to the electrical appliance 102; and when the ON terminal is de-actuated or the OFF terminal is actuated (e.g., the second half of the front side of the electric switch is pressed) the power supply node is disconnected to the node that is connected to the electrical appliance 102 and the power supply is cut-off from the electrical appliance 102.

Accordingly, the electrical appliance 102 is turned 'ON' by pressing or flipping any electric switch from among the electric switches 104-108 to its 'ON' terminal. For example, upon switching 'ON' the electric switch 104 that is by pressing or flipping the electric switch 104 to actuate its 'ON' terminal, the electrical appliance 102 is turned 'ON'. Similarly, by pressing or flipping the electric switch 106 to its 'OFF' terminal, the OFF terminal is actuated thereby turning OFF the electrical appliance 102. Similarly, by pressing or flipping the electric switch 108 to its 'ON' terminal, the electrical appliance 102 is turned 'ON' again. Typically, when multiple electric switches (such as the electric switches 104-108) control an electrical appliance such as the electrical appliance 102, each of the switches is not always in 'ON' position when the electrical appliance is switched 'ON' or is not always in 'OFF' position when the electrical appliance is switched 'OFF'.

Various embodiments of the present disclosure provide switching apparatus for controlling switching operation of an electrical appliance such that when one electric switch is pressed or flipped to attain one operating position, all other electric switches are also flipped in unison to attain the same operating position, and thereby ensuring that all of the electric switches remain in same operating position. Such embodiments are described herein with references to FIGS. 2 and 3.

Figure 2:
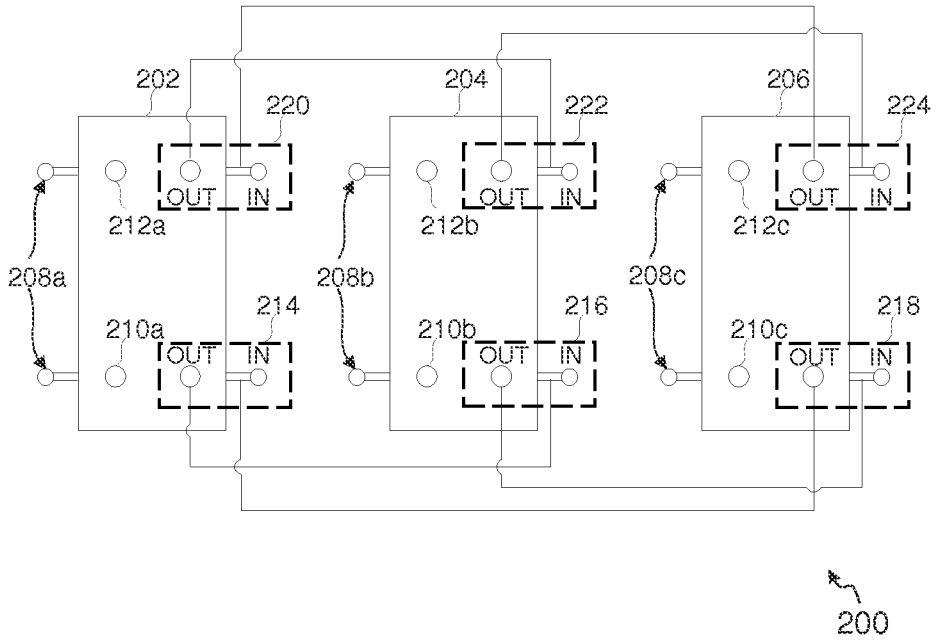
FIG. 2 is a schematic illustration of a switching apparatus for performing switching operation of the electrical appliance in accordance with an embodiment of the present disclosure

FIG. 2 illustrates a switching apparatus 200 for performing switching operation of an electrical appliance, in accordance with an embodiment of the present disclosure. The switching apparatus 200 includes a plurality of electric switches such as an electric switch 202, an electric switch 204 and an electric switch 206 (hereinafter referred to as the electric switches 202-206). The electric switches 202-206 are electrically connected to an electrical appliance such as the electrical appliance 102 shown in FIG. 1. The electric switches 202-206 are configured to receive power supply, for example, an alternating-current (AC) power supply of about 100-230 volts at their power terminal such as power terminals 208*a*, 208*b* and 208*c* associated with the electric switches 202-206, respectively. Further, each electric switch from among the electric switches 202-206 includes an ON terminal and an OFF terminal. For example, the electric switch 202 includes an ON terminal 210*a* and an OFF terminal 212*a*; the electric switch 204 includes an ON terminal 210*b* and an OFF terminal 212*b*; and the electric switch 206 includes an ON terminal 210*c* and an OFF terminal 212*c*, respectively. The electric switches 202-206, when flipped or pressed towards the ON terminals 210*a*-210*c*, are configured to switch ON the electrical appliance. For instance, when the electric switch 202 is pressed towards the ON terminal 210*a*, the ON terminal 210*a* is connected to the power terminal 208*a* such that power supply is provided to the electrical appliance. Similarly, the electric switches

202-206, when flipped or pressed towards the OFF terminals 212*a*-212*c*, are configured to switch OFF the electrical appliance, respectively. For instance, when the electric switch 202 is pressed towards the OFF terminal 210*b*, the connection between the ON terminal 210*a* and the power terminal 208*a* breaks and that power supply is cut-off from the electrical appliance.

When any of the electric switches 202-206 is pressed to assume an operating position (e.g., pressed towards the ON terminals 210*a*-210*c* or the OFF terminals 212*a*-212*c*), remaining electric switches of the electric switches 202-206 also assume the same operating position, and such mechanism is achieved by electro-magnetic forces as described herein. Herein for the purposes of this description, it should be noted that each electric switch may assume two operating positions namely an ON operating position and an OFF operating position. In the ON operating position, the electric switch is pressed such that the ON terminal is actuated and an electrical connection is made between the power supply and a node connected to the electrical appliance, and in the OFF operating position the electric switch is pressed such that the OFF terminal is actuated and there is no electrical connection between the power supply and the node connected to the electrical appliance.

In an embodiment, the switching apparatus 200 includes a plurality of ON solenoid devices 214-218 electro-magnetically coupled to the ON terminals 210*a*-210*c* of the electric switches 202-206 in a respective manner. For example, the electric switch 202 is connected to an ON solenoid device 214; the electric switch 204 is connected to an ON solenoid device 216; and the electric switch 206 is connected to an ON solenoid device 218, respectively. Also, the ON solenoid devices 214-218 are electrically connected to each other. In an embodiment, the plurality of ON solenoid devices 214-218 are electro-mechanical solenoid devices, where each of the ON solenoid devices 214-218 is a type of electro-magnet configured to generate a controlled magnetic field. More specifically, each of the ON solenoid devices 214-218 includes an electro-magnetically inductive coil (not shown in figures) wound around a movable armature configured to move in and out of a metal casing, thereby providing mechanical force for flipping the corresponding electric switch. Each of the ON solenoid devices 214-218 includes an input terminal (shown as 'IN' in FIG. 2) and an output terminal (shown as 'OUT' in FIG. 2). The ON solenoid devices 214-218 are connected to each other such that an input terminal of one ON solenoid device is connected to output terminal of at least one other ON solenoid device. For example, the input terminal of the ON solenoid device 214 is connected to the output terminal of the ON solenoid device 218. Similarly, the input terminal of the ON solenoid device 216 is connected to the output terminal of the ON solenoid device 214 and the input terminal of the ON solenoid device 218 is connected to the output terminal of the ON solenoid device 216, respectively.

Further, the switching apparatus 200 includes a plurality of OFF solenoid devices 220-224 electro-magnetically coupled to the OFF terminals 212*a*-212*c* of the electric switches 202-206 in a respective manner. More specifically, the electric switch 202 is connected to an OFF solenoid device 220; the electric switch 204 is connected to an OFF solenoid device 222; and the electric switch 206 is connected to an OFF solenoid device 224, respectively. Each of the OFF solenoid devices 220-224 includes an input terminal (shown as 'IN' in FIG. 2) and an output terminal (shown as 'OUT' in FIG. 2), as shown in FIG. 2. Also, the OFF solenoid devices 220-224 are electrically connected to each other. In an embodiment, the plurality of OFF solenoid devices 220-224 are electro-mechanical solenoid devices, where each of the OFF solenoid devices 220-224 are a type of electromagnet configured to generate a controlled magnetic field. More specifically, the OFF solenoid devices 220-224 includes an electro-magnetically inductive coil (not shown in figures) wound around a movable armature configured to move in and out of a metal casing, thereby providing mechanical force for flipping an electric switch. Further, an input terminal of one OFF solenoid device is connected to an output terminal of another OFF solenoid device. For example, as shown in the FIG. 2, the input terminal of the OFF solenoid device 220 is connected with the output terminal of the OFF solenoid device 224. Similarly, the input terminal of the OFF solenoid device 222 is connected to the output terminal of the OFF solenoid device 220 and the input terminal of the OFF solenoid device 224 is connected to the output terminal of the OFF solenoid device 222, respectively.

In an embodiment, as shown in FIG. 2, upon actuating an ON terminal of an electric switch such as the electric switch 202, the respective ON solenoid device (i.e., the ON solenoid device 214) coupled to the electric switch 202 is activated and the OFF solenoid device 220 is de-activated. Further, the activation of the ON solenoid device 214 causes activation of the remaining ON solenoid devices 216 and 218, which are interconnected. Also, the remaining OFF solenoid devices 220-224 are de-activated because of the de-activation of the OFF solenoid device 220. Thereafter, activation of the remaining ON solenoid devices 216 and 218 and the de-activation of the remaining OFF solenoid devices 220-224 causes conducive electro-magnetic forces to flip the remaining electric switches 204 and 206 to their ON operating positions. Therefore, by flipping one electric switch (any one from among the electric switches 202-206) towards its ON terminal, all the remaining electric switches are automatically flipped to their ON terminals by the respective ON solenoid devices 214-218. One example of switching operation of the electric switches 202-206 to the ON operating positions, is explained with reference to FIG. 4A.

Further, upon actuating an OFF terminal of an electric switch such as the electric switch 202, the respective OFF solenoid device 220 that is coupled to the electric switch 202 is activated and the ON solenoid device 214 is de-activated. Further, the activation of the respective OFF solenoid device 220 causes activation of the remaining OFF solenoid devices 222 and 224, which are interconnected. Also, the remaining ON solenoid devices 216-218 are de-activated because of the de-activation of the ON solenoid device 214. Thereafter, activation of the remaining OFF solenoid devices 222 and 224 and the de-activation of the remaining ON solenoid devices 214-218 causes conducive electro-magnetic forces to flip the remaining electric switches 204 and 206 to their OFF operating positions. Therefore, by flipping one electric switch (any one from among the electric switches 202-206) towards its OFF terminal, all the remaining electric switches are automatically flipped to their OFF terminals by the respective OFF solenoid devices 220-224. One example of switching operation of the electric switches 202-206 to the OFF operating positions, is explained with reference to FIG. 4B.

Figure 3:
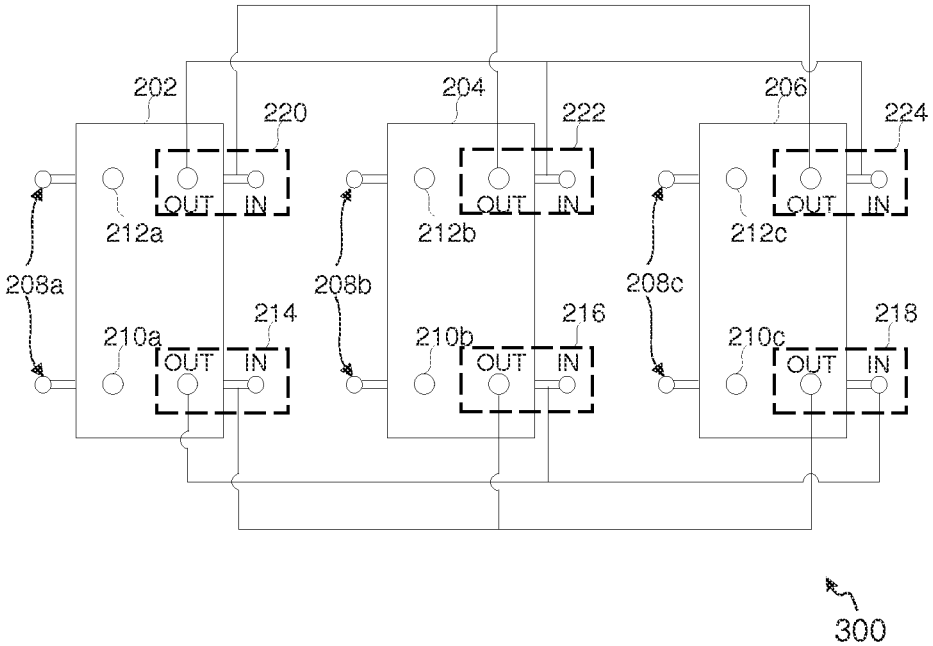
FIG. 3 is a schematic illustration of a switching apparatus for performing switching operation of the electrical appliance in accordance with another embodiment of the present disclosure

In another embodiment, FIG. 3 shows a switching apparatus 300 for performing switching operation of an electrical appliance, in accordance with another embodiment of the present disclosure. The switching apparatus 300 includes the ON solenoid devices 214-218 and the OFF solenoid devices 220-224 connected in a different configuration than that of the switching apparatus 200 as shown in FIG. 2. More specifically, each of the ON solenoid devices 214-218 is connected directly to other remaining solenoid devices of the ON solenoid devices 214-218. Such a configuration enables simultaneous actuation of the electric switches 202-206 towards the corresponding ON operating position (i.e., actuation of the ON terminals) upon pressing or flipping at least one electric switch from among the electric switches 202-206. As shown in FIG. 3, the input terminal (shown as 'IN' in FIG. 3) of the ON solenoid device 214 is directly connected to the output terminals (shown as 'OUT' in FIG. 3) of the ON solenoid devices 216 and 218. Similarly, the output terminal of the ON solenoid device 214 is directly connected to the input terminals of the ON solenoid devices 216 and 218. Accordingly, in such a configuration, by pressing or flipping the electric switch 202 towards the ON terminal 210*a* causes the ON solenoid device 214 to be activated. The activation of the ON solenoid device 214 simultaneously activates the ON solenoid devices 216 and 218, thereby electro-magnetically actuating (or flipping) the electric switches 204 and 206 towards the respective ON terminals 210*b* and 210*c*.

Further, as shown in FIG. 3, the input terminal (shown as 'IN' in FIG. 3) of the OFF solenoid device 220 is directly connected to the output terminals (shown as 'OUT' in FIG. 3) of the OFF solenoid devices 222 and 224. Similarly, the output terminal of the OFF solenoid device 220 is directly connected to the input terminals of the OFF solenoid devices 222 and 224. Accordingly, in such a configuration, when the electric switch 202 is pressed/flipped towards the OFF terminal 212*a*, the OFF solenoid device 220 is activated. The activation of the OFF solenoid device 220 simultaneously activates the OFF solenoid devices 222 and 224, thereby electro-magnetically actuating (or flipping) the electric switches 204 and 206 towards the respective OFF terminals 212*b* and 212*c*.

It is noted that the ON solenoid devices 214-218 and the OFF solenoid devices 220-224 may be electrically connected in any configuration other that the configurations shown in FIGS. 2 and 3 for simultaneously (or with a small delay) flipping the rest of the electric switches upon flipping the one electric switch from among the electric switches 202-206.

Figure 4A:
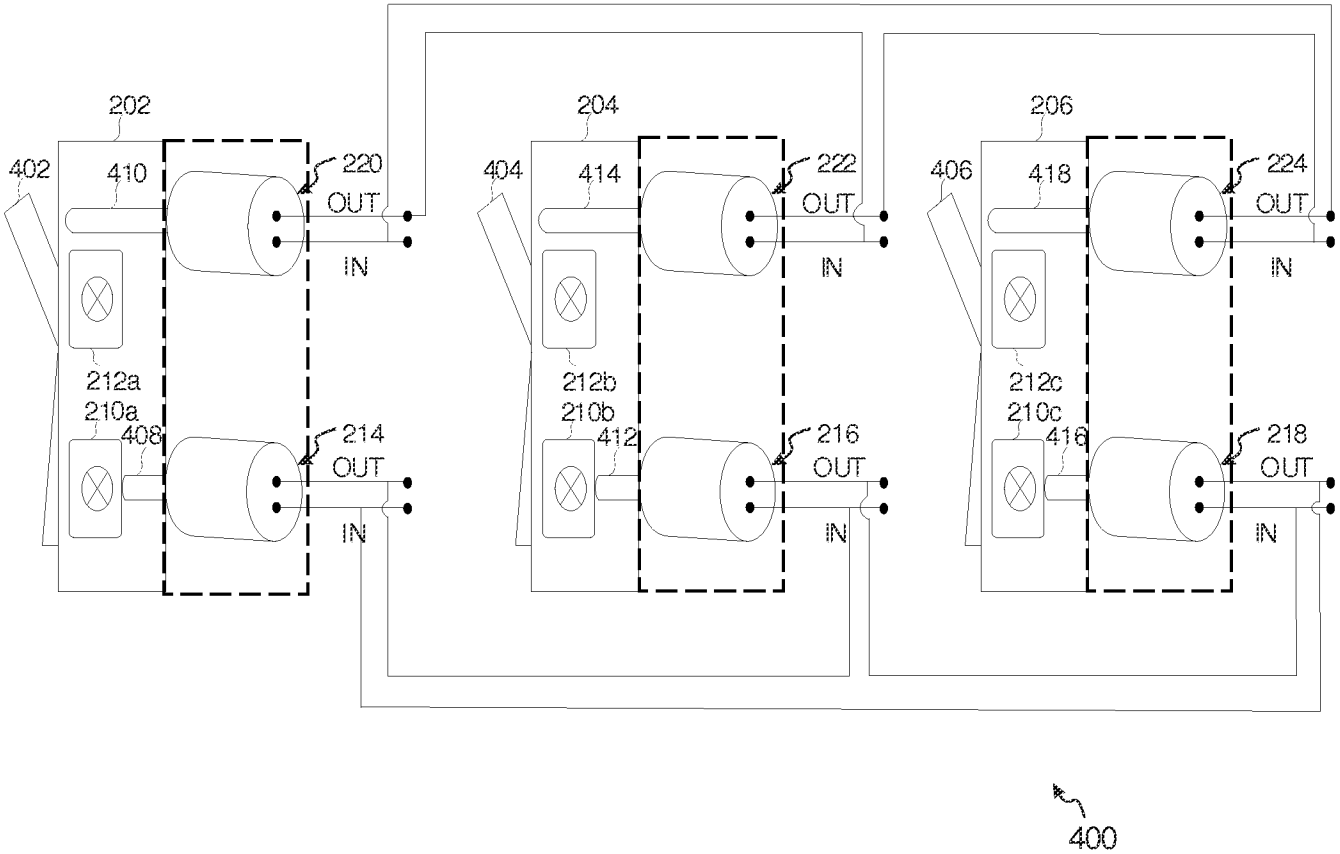
FIGS. 4A and 4B illustrate switching operation of the switching apparatus of FIG. 2 in accordance with an embodiment of the present disclosure.
Figure 4B:
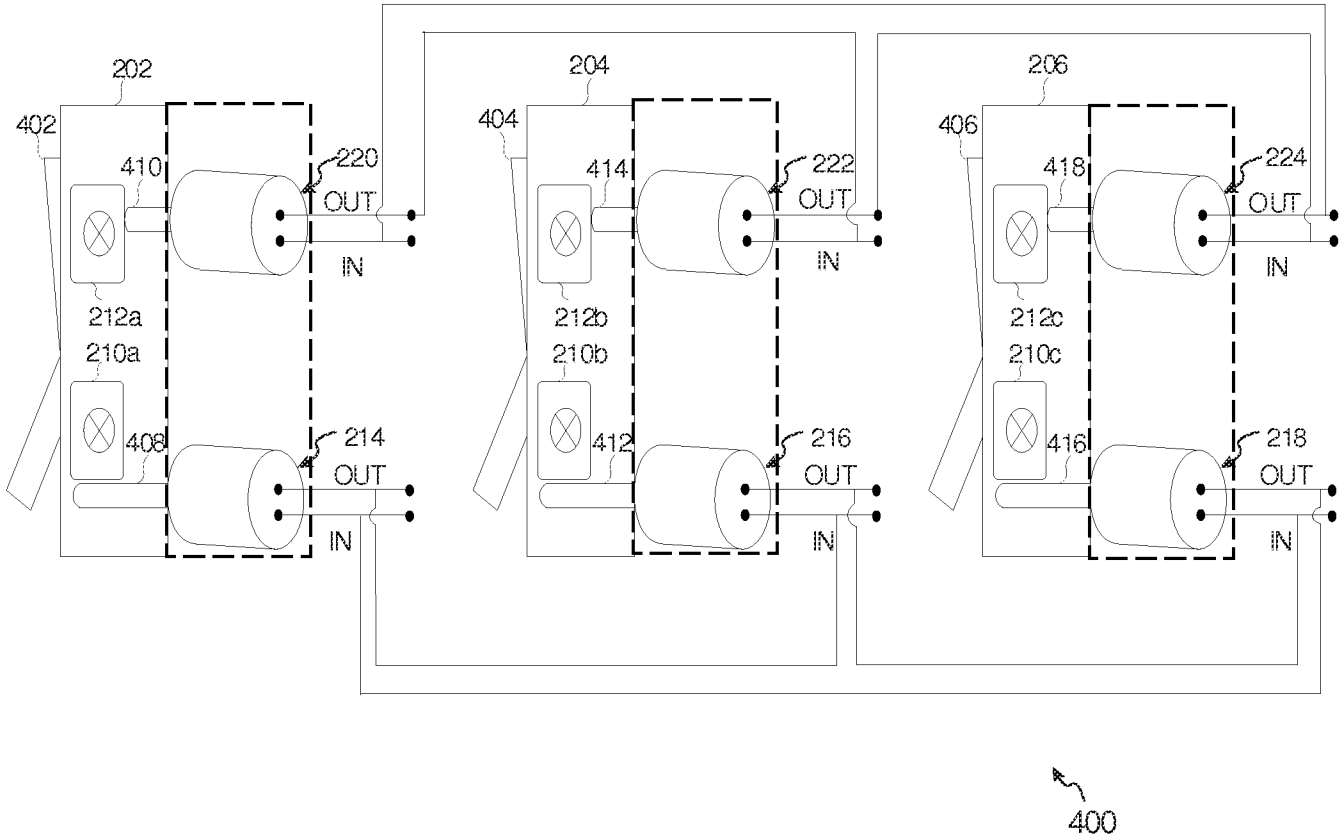

Switching operation of the electric switches by their corresponding ON solenoid devices and OFF solenoid devices is explained further with reference to FIGS. 4A and 4B.

As shown in FIGS. 4A and 4B, switching operation of a switching apparatus 400 is explained in accordance with an example embodiment of the present disclosure. The switching apparatus 400 is an example of the switching apparatus 200 explained with reference to FIG. 2. However, it is noted that the switching apparatus 400 may also be implemented in a different configurations for example the switching apparatus 300 as shown in FIG. 3.

Referring to FIG. 4A, the switching apparatus 400 illustrates the electric switches 202-206 actuated in ON operating position. The electric switches 202-206 include toggle buttons 402, 404 and 406, respectively, which may be flipped towards the respective ON terminals 210*a*, 210*b* and 210*c* or the respective OFF terminals 212*a*, 212*b* and 212*c*. In FIG. 4A, the toggle buttons 402-406 of the respective electric switches 202-206 are shown to be pressed or flipped (by a user) towards the ON terminals 210*a*, 210*b* and 210*c*, respectively. The toggle buttons 402-406 may be supported by a switch plate or a switch frame (not visible in FIG. 4A or FIG. 4B). As explained in FIGS. 2 and 3, the electric switches 202-206 are associated with the ON solenoid devices 214-218 and the OFF solenoid devices 220-224. Each of the ON solenoid devices 214-218 and the OFF solenoid devices 220-224 includes an armature wound around a coiled wire inside a casing, for example, as shown in an electro-mechanical solenoid device explained with reference to FIG. 5.

Figure 5:
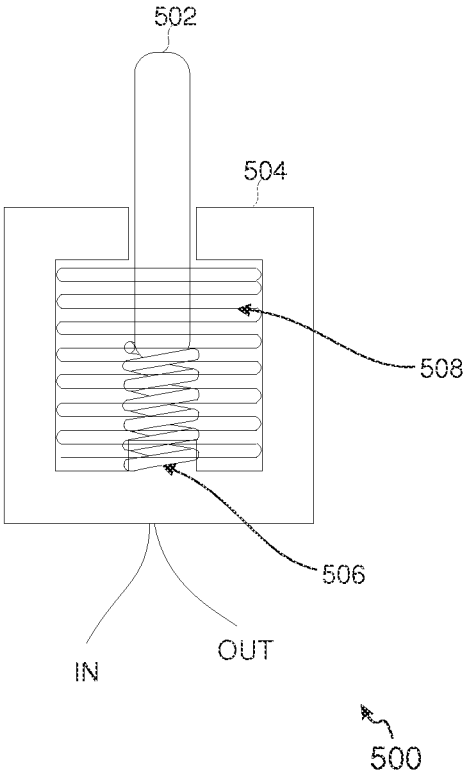
FIG. 5 illustrates an electro-mechanical solenoid device in accordance with an example embodiment of the present disclosure.

FIG. 5 illustrates a schematic representation of an electro-mechanical solenoid device 500 (hereinafter referred to as the solenoid device 500) in accordance with an example embodiment of the present disclosure. The solenoid device 500 is an example of the ON solenoid devices 214-218 or the OFF solenoid devices 220-224 explained in FIGS. 2, 3 and 4A-4B. The solenoid device 500 includes a movable armature 502 (hereinafter referred to as the 'armature 502') enclosed in a casing 504. In an example, scenario, the armature 502 and the casing 504 may be made of metal such as but not limited to iron or steel. Further, the armature 502 includes a spring 506 attached to a bottom portion of the armature 502. Thereafter, the armature 502 is wound with a coiled wire 508, where ends of the coiled wire 508 form the input (IN) and output terminals (OUT) respectively. The coiled wire 508 may be made of metal wires such as but not limited to copper wire or aluminium wire. The armature 502 of the solenoid device 500 in a de-actuated position (i.e., when not connected to the electrical power supply) is slightly protruding outside the casing 504, and in an actuated position (i.e., when connected to the electrical power supply) is inside the casing 504. More specifically, when electric current is passed through the coiled wire 508, the solenoid device 500 is activated and a magnetic field is created inside the casing 504. The magnetic field created inside the casing 504 pulls the armature 502 inside the casing 504 such that the armature 502 assumes the actuated position. In the actuated position, the armature 502 compresses the spring 506 which is attached at the bottom portion of the armature 502. Similarly, upon de-activating the solenoid device 500, the armature 502 is pushed out of the casing 504 to its original position (i.e., de-actuated position) due to the mechanical energy provided by the spring 506. Without loss of generality, a mechanical force, with which the armature 502 comes back to its de-actuated position, is used for flipping an electric switch as explained in FIGS. 2-3. However, the movement of the armature 502 may be utilized in other forms for flipping the electric switch as well. For instance, when the armature 502 moves towards the actuated position, it may pull the electric switch towards an operating position such as the ON or OFF operating positions.

Referring back to FIG. 4A, in an example scenario, upon switching or flipping the toggle button 402 towards the ON terminal 210*a* of the electric switch 202, the ON solenoid device 214 is activated, such that an armature 408 (such as the armature 502 of the solenoid device 500 explained in FIG. 5) of the ON solenoid device 214 is pulled inside a casing (such as the casing 504) of the ON solenoid device 214 to be in an actuated position. Similarly, since the OFF solenoid device 220 is in a de-activated state, an armature 410 of the OFF solenoid device 220 is shown to be protruding out of a casing of the OFF solenoid device 220 in a de-actuated position. Accordingly, the activation of the ON solenoid device 214 causes activation of the ON solenoid device 216, such that, an armature 412 of the ON solenoid device 216 is in an actuated position (i.e., inside a casing of the ON solenoid device 216). Also, the de-activation of the OFF solenoid device 220 causes de-activation of the OFF solenoid device 222, and thereby a mechanical force enables the de-actuated position of an armature 414 of the OFF solenoid device 222. For example, the armature 414 is pushed outside a casing of the OFF solenoid device 222. The mechanical force with which the armature 414 comes out of the casing of the OFF solenoid device 222 causes the toggle button 404 of the electric switch 204 to be flipped towards the ON terminal 210*b*.

Further, the activation of the ON solenoid device 216 causes activation of the ON solenoid device 218, such that, an armature 416 of the ON solenoid device 218 is in an actuated position (i.e., inside a casing of the ON solenoid device 218). Also, the de-activation of the OFF solenoid device 222 causes de-activation of the OFF solenoid device 224, and thereby a mechanical force enables the de-actuated position of an armature 418 of the OFF solenoid device 224. For example, the armature 418 is pushed outside a casing of the OFF solenoid device 224. The mechanical force with which the armature 418 comes out of the casing of the OFF solenoid device 224 causes the toggle button 406 of the electric switch 206 to be flipped towards its ON terminal 210*c*.

In FIG. 4B, the toggle buttons 402-406 of the respective electric switches 202-206 are shown to be pressed or flipped towards the OFF terminals 212*a*, 212*b* and 212*c*, respectively. In an example scenario, upon flipping the toggle button 402 towards the OFF terminal 212*a* of the electric switch 202, the OFF solenoid device 220 is activated, such that the armature 410 (such as the armature 502 of the solenoid device 500 explained in FIG. 5) of the OFF solenoid device 220 is pulled inside the casing (such as the casing 504) of the OFF solenoid device 220 to be in an actuated position. Similarly, since the ON solenoid device 214 is in a de-activated state, the armature 408 of the ON solenoid device 214 is in the de-actuated position and is shown to be protruding outside of the casing of the ON solenoid device 214. Accordingly, the activation of the OFF solenoid device 220 causes activation of the OFF solenoid device 222 such that the armature 414 of the OFF solenoid device 222 is in an actuated position (i.e., inside a casing of the OFF solenoid device 222). Also, the de-activation of the ON solenoid device 214 causes de-activation of the ON solenoid device 216, thereby pushing the armature 412 of the ON solenoid device 216 outside a casing of the ON solenoid device 216. A mechanical force with which the armature 412 comes out of the casing of the ON solenoid device 216 causes the toggle button 404 of the electric switch 204 to be flipped towards its OFF terminal 212*b*.

Further, the activation of the OFF solenoid device 222 causes activation of the OFF solenoid device 224, such that, the armature 418 of the OFF solenoid device 224 is in an actuated position (i.e., inside a casing of the OFF solenoid device 224). Also, the de-activation of the ON solenoid device 216 causes de-activation of the ON solenoid device 218, thereby pushing the armature 416 of the ON solenoid device 218 outside a casing of the ON solenoid device 218. A mechanical force with which the armature 416 comes out of the casing of the ON solenoid device 218 causes the toggle button 406 of the electric switch 206 to be flipped towards its OFF terminal 212*c*.

Therefore, as explained in FIGS. 4A and 4B, by pressing at least one electric switch from among a plurality of electric switches towards an operating position (i.e., towards an ON or an OFF terminal), all the remaining electric switches are actuated towards the same operating position due to corresponding activation and de-activation of the ON solenoid devices and OFF devices associated with the plurality of electric switches, respectively.

Modifications to embodiments of the invention described in the foregoing are possible without departing from the scope of the invention as defined by the accompanying claims. Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural. Numerals included within parentheses in the accompanying claims are intended to assist understanding of the claims and should not be construed in any way to limit subject matter claimed by these claims.

What is claimed is:

1. A switching apparatus for an electrical appliance, the switching apparatus comprising:

a plurality of electric switches electrically connected to the electrical appliance, each electric switch of the plurality of electric switches configured to be flipped to an ON operating position for switching ON the electrical appliance and configured to be flipped to an OFF operating position for switching OFF the electrical appliance;

a plurality of ON solenoid devices electro-magnetically coupled to ON terminals corresponding to ON operating positions of the plurality of electric switches in a respective manner, wherein the plurality of ON solenoid devices are electrically connected to each other; and a plurality of OFF solenoid devices electro-magnetically coupled to OFF terminals corresponding to OFF operating positions of the plurality of electric switches in a respective manner, wherein the plurality of OFF solenoid devices are electrically connected to each other;

wherein when an electric switch of the plurality of electric switches is flipped to an ON operating position of the electric switch, a respective OFF solenoid device coupled to the electric switch is de-activated that causes de-activation of remaining OFF solenoid devices of the plurality of OFF solenoid devices thereby electro-magnetically flipping remaining electric switches of the plurality of electric switches to respective ON operating positions, and wherein when the electric switch is flipped to an OFF operating position of the electric switch, a respective ON solenoid device coupled to the electric switch is de-activated that causes de-activation of remaining ON solenoid devices of the plurality of ON solenoid devices thereby electro-magnetically flipping the remaining electric switches to respective OFF operating positions.

2. The switching apparatus according to claim 1, wherein the plurality of ON solenoid devices and the plurality of OFF solenoid devices are electro-mechanical solenoid devices.

3. The switching apparatus according to claim 2, wherein an ON solenoid device of the plurality of ON solenoid devices comprises a movable armature configured within a casing, the movable armature configured to exert an electro-magnetic force on a respective electric switch coupled to the ON solenoid device for flipping the respective electric switch.

4. The switching apparatus according to claim 2, wherein an OFF solenoid device of the plurality of OFF solenoid devices comprises a movable armature configured within a casing, the movable armature configured to exert an electro-magnetic force on a respective electric switch coupled to the OFF solenoid device for flipping the respective electric switch.

5. The switching apparatus according to claim 1, where each of the plurality of ON solenoid devices comprises an input terminal and an output terminal, wherein an output terminal of the respective ON solenoid device is electrically coupled to input terminal of each of the remaining ON solenoid devices, and an input terminal of the respective ON solenoid device is electrically coupled to output terminal of each of the remaining ON solenoid devices.

6. The switching apparatus according to claim 1, where each of the plurality of OFF solenoid devices comprises an input terminal and an output terminal, wherein an output terminal of the respective OFF solenoid device is electrically coupled to input terminal of each of the remaining OFF solenoid devices, and an input terminal of the respective OFF solenoid device is electrically coupled to output terminal of each of the remaining OFF solenoid devices.

7. The switching apparatus according to claim 1, wherein the electric switch comprises at least one of a push button switch, a toggle switch and a rocker switch.

8. A switching apparatus for an electrical appliance, the switching apparatus comprising:

a plurality of electric switches electrically connected to the electrical appliance, each of the plurality of electric switches configured to be flipped to an ON operating position for switching ON the electrical appliance and configured to be flipped to an OFF operating position for switching OFF the electrical appliance;

a plurality of ON solenoid devices electro-magnetically coupled to ON terminals corresponding to ON operating positions of the plurality of electric switches in a respective manner, wherein the plurality of ON solenoid devices are electrically connected to each other; and a plurality of OFF solenoid devices electro-magnetically coupled to OFF terminals corresponding to OFF operating positions of the plurality of electric switches in a respective manner, wherein the plurality of OFF solenoid devices are electrically connected to each other;

wherein when an electric switch of the plurality of electric switches is flipped to an ON operating position of the electric switch, a respective ON solenoid device coupled to the electric switch is activated that causes activation of remaining ON solenoid devices of the plurality of ON solenoid devices thereby electro-magnetically flipping remaining electric switches of the plurality of electric switches to respective ON operating positions, and wherein when the electric switch is flipped to an OFF operating position of the electric switch, a respective OFF solenoid device coupled to the electric switch is activated that causes activation of remaining OFF solenoid devices of the plurality of OFF solenoid devices thereby electro-magnetically flipping the remaining electric switches to respective OFF operating positions.

9. The switching apparatus according to claim 8, wherein the plurality of ON solenoid devices and the plurality of OFF solenoid devices are electro-mechanical solenoid devices.

10. The switching apparatus according to claim 9, wherein an ON solenoid device of the plurality of ON solenoid devices comprises a movable armature configured within a casing, the movable armature configured to exert an electro-magnetic force on a respective electric switch coupled to the ON solenoid device for flipping the respective electric switch.

11. The switching apparatus according to claim 9, wherein an OFF solenoid device of the plurality of OFF solenoid devices comprises a movable armature configured within a casing, the movable armature configured to exert an electro-magnetic force on a respective electric switch coupled to the OFF solenoid device for flipping the respective electric switch.

12. The switching apparatus according to claim 8, where each of the plurality of ON solenoid devices comprises an input terminal and an output terminal, wherein an output terminal of the respective ON solenoid device is electrically coupled to input terminal of each of the remaining ON solenoid devices, and an input terminal of the respective ON solenoid device is electrically coupled to output terminal of each of the remaining ON solenoid devices.

13. The switching apparatus according to claim 8, where each of the plurality of OFF solenoid devices comprises an input terminal and an output terminal, wherein an output terminal of the respective OFF solenoid device is electrically coupled to input terminal of each of the remaining OFF solenoid devices, and an input terminal of the respective OFF solenoid device is electrically coupled to output terminal of each of the remaining OFF solenoid devices.

14. The switching apparatus according to claim 8, wherein the electric switch comprises at least one of a push button switch, a toggle switch and a rocker switch.

15. A switching apparatus for an electrical appliance, the switching apparatus comprising:

a plurality of electric switches electrically connected to the electrical appliance, each of the plurality of electric switches configured to be flipped to an ON operating position for switching ON the electrical appliance and configured to be flipped to an OFF operating position for switching OFF the electrical appliance;

a plurality of ON solenoid devices electro-magnetically coupled to ON terminals corresponding to ON operating positions of the plurality of electric switches in a respective manner, wherein the plurality of ON solenoid devices are electrically connected to each other; and a plurality of OFF solenoid devices electro-magnetically coupled to OFF terminals corresponding to OFF operating positions of the plurality of electric switches in a respective manner, wherein the plurality of OFF solenoid devices are electrically connected to each other;

wherein when an electric switch of the plurality of electric switches is flipped to an ON operating position of the electric switch, a respective ON solenoid device coupled to the electric switch is activated and a respective OFF solenoid device coupled to the electric switch is de-activated that cause activation of remaining ON solenoid devices of the plurality of ON solenoid devices and de-activation of remaining OFF solenoid devices of the plurality of OFF solenoid devices, thereby electro-magnetically flipping remaining electric switches of the plurality of electric switches to respective ON operating positions; and wherein when the electric switch is flipped to an OFF operating position of the electric switch, the respective OFF solenoid device is activated and the respective ON solenoid device is de-activated that cause activation of the remaining OFF solenoid devices and de-activation of the remaining ON solenoid devices, thereby electro-magnetically flipping the remaining electric switches to respective OFF operating positions.

16. The switching apparatus according to claim 15, wherein the plurality of ON solenoid devices and the plurality of OFF solenoid devices are electro-mechanical solenoid devices.

17. The switching apparatus according to claim 16, wherein an ON solenoid device of the plurality of ON solenoid devices comprises a movable armature configured within a casing, the movable armature configured to exert an electro-magnetic force on a respective electric switch coupled to the ON solenoid device for flipping the respective electric switch.

18. The switching apparatus according to claim 16, wherein an OFF solenoid device of the plurality of OFF solenoid devices comprises a movable armature configured within a casing, the movable armature configured to exert an electro-magnetic force on a respective electric switch coupled to the OFF solenoid device for flipping the respective electric switch.

19. The switching apparatus according to claim 15, where each of the plurality of ON solenoid devices comprises an input terminal and an output terminal, wherein an output terminal of the respective ON solenoid device is electrically coupled to input terminal of each of the remaining ON solenoid devices, and an input terminal of the respective ON solenoid device is electrically coupled to output terminal of each of the remaining ON solenoid devices.

20. The switching apparatus according to claim 15, where each of the plurality of OFF solenoid devices comprises an input terminal and an output terminal, wherein an output terminal of the respective OFF solenoid device is electrically coupled to input terminal of each of the remaining OFF solenoid devices, and an input terminal of the respective OFF solenoid device is electrically coupled to output terminal of each of the remaining OFF solenoid devices.

* * * * *